US005439525A

United States Patent [19]

Peichl et al.

[11] Patent Number: 5,439,525

[45] Date of Patent: Aug. 8, 1995

[54] DEVICE FOR COATING HOLLOW WORKPIECES BY GAS DIFFUSION

[75] Inventors: Lothar Peichl, Dachau; Heinrich Walter, Friedberg, both of Germany

[73] Assignee: MTU Motoren- und Turbinen-Union Muenchen GmbH, Munich, Germany

[21] Appl. No.: 50,271

[22] PCT Filed: Oct. 29, 1991

[86] PCT No.: PCT/EP91/02039

§ 371 Date: May 7, 1993

§ 102(e) Date: May 7, 1993

[87] PCT Pub. No.: WO92/08821

PCT Pub. Date: May 29, 1992

[30] Foreign Application Priority Data

Nov. 10, 1990 [DE] Germany ..... 40 35 789.9

[51] Int. Cl.[6] ..... C23C 16/00

[52] U.S. Cl. ..... 118/726; 118/715; 118/725

[58] Field of Search ..... 118/715, 726, 725

[56] References Cited

U.S. PATENT DOCUMENTS 2,910,382 10/1959 Vulliez ..... 427/253

FOREIGN PATENT DOCUMENTS 68950 1/1983 European Pat. Off. .
1130118 9/1956 France .
1134753 4/1957 France .
825847 2/1956 United Kingdom .
975202 5/1962 United Kingdom .

*Primary Examiner*—Richard Bueker
*Attorney, Agent, or Firm*—Evenson, McKeown, Edwards & Lenahan

[57] ABSTRACT

A device for coating hollow workpieces made of heat-resistant alloys, such as Ni, Co or Fe base alloy via gas diffusion is provided. The outer and inner surfaces of the workpieces are linked with one another by bores. The workpieces are arranged in a container which is located in a processing chamber. The workpiece holders are arranged at a geodetically low height with respect to a donor metal body. The donor metal body made of granulates, sintered metal or compact metal completely surrounds the outer surfaces of each workpiece to be coated while maintaining a gap. The device is suitable for the inner and outer coating of power unit blades with cooling air bores.

11 Claims, 3 Drawing Sheets

DEVICE FOR COATING HOLLOW WORKPIECES BY GAS DIFFUSION

BACKGROUND AND SUMMARY OF THE INVENTION

The invention relates to a device for coating, by means of gas diffusion, hollow workpieces made of heat-resistant alloys, such as Ni, Co or Fe base alloys, whose outer and inner surfaces are connected with one another by bores. The device comprises a container which has at least one gas supply line and one gas removal line. The gas removal line is connected behind the inner surfaces of the workpiece to be coated, and has a donor metal in the form of a donor metal body which completely surrounds the outer and inner surfaces of the workpiece to be coated while maintaining a gap.

From U.S. Pat. No. 2,910,382, a process is known for producing surface alloys on metal components. For this purpose, a donor metal in the form of a sintered body is placed at a distance opposite the component surfaces to be coated and, while the inner surfaces are also coated, the hollow spaces of the component are filled with sintered bodies made of donor metal so that a sintered body is situated also opposite the component surfaces in the hollow spaces.

This known process has the disadvantage that inner surfaces which are inaccessible or have a complex design cannot be coated because it is not possible to introduce a donor metal body into the pertaining hollow spaces of the component.

From the European Patent Document EP 0349420, a device is known for the simultaneous coating by gas diffusion of outer and inner surfaces. In the case of this device, the components to be coated are arranged in the upper area of a box. In the lower area, the box has a carrier gas supply line and a carrier grid for receiving an activator powder and donor metal granulates. This device has the disadvantage that forming heavy donor metal gases must rise from the donor metal granulates to the components to be coated, in which case, corresponding to the barometric height formula, a dilution of the donor metal gases occurs in the vertical direction which disadvantageously results in differences in layer thicknesses on the components as a function of their geodetic height with respect to the donor metal. In addition, the device has the effect that the inner surfaces of the component, with an increasing distance of connecting bores between outer and inner surfaces, have smaller coating thicknesses until the coating in the component interior is completely absent.

It is an object of the present invention to provide a device for coating by gas diffusion by which a uniform coating of a hollow component on the outer and inner surfaces is ensured, particularly in the case of long, narrow and inaccessible hollow spaces.

This object is achieved by a device according to the present invention which has the above-described characteristics and in the case of which workpiece holders are arranged in the container. The container holds the workpieces at a geodetically low height with respect to a donor metal. The hollow spaces are free of donor metal, and the gas removal line is constructed as an overflow device or as a front-connected siphon whose overflow level is positioned at the height of the uppermost surface of the workpiece to be coated.

This device has the advantage that, in the interior of the component as well as on the outside, coating thicknesses are obtained which have low thickness fluctuations. By means of the complete surrounding of the component with donor metal, while a gap to the donor is maintained, the surface of the component is supplied with a constantly high concentration of donor metal gas without any diluting effect of the donor metal gas as a result of its high carrier gas proportion, and without donor metal particles in the interior of the component so that the danger of a clogging of the hollow spaces and of the bores between the outer and inner surfaces is avoided.

Using the workpiece holders, which hold the workpieces at a geodetically low height with respect to the donor metal, the components are advantageously held in an inexhaustible high-concentration donor metal gas source. The gas source forms as a result of the small gap to the donor metal body and the surrounding of the components by the donor metal body in the device according to the present invention.

By way of openings, preferably bores, on the outer surface of the component, the donor metal gas can diffuse into the interior and fill the hollow spaces. The filling and supplying of the hollow spaces with donor metal gas may be accelerated by the introduction of gases by way of the gas supply line and the removal may be accelerated by way of the gas removal line connected behind the inner surfaces. This is particularly advantageous in the case of components with very partitioned hollow spaces, relatively small cross-sectional surfaces of the openings in the outer surface in comparison to the inner surfaces to be coated, or in the case of long, small connecting bores between outer and inner surfaces. This device is preferably suitable for the coating by gas diffusion of power unit blades with cooling ducts and cooling-air bores.

The construction of the gas removal line as an overflow device or front-connected siphon whose overflow level is positioned at least at the level of the uppermost surface of the workpiece to be coated has the advantage that the height of the donor metal gas sump can be adapted to the height of the component. Since the heavy donor metal gas can escape only by way of the overflow device as the threshold, an overflow device or siphon ensures a uniformly high donor metal concentration inside and outside the component.

The workpiece holder preferably comprises a conical seat which has a centrally arranged gas removal duct and corresponds with connecting bores leading to hollow spaces of the workpieces. This conical seat has the advantage that not only the workpiece is held in position, but transition pieces for receiving the components can also be used which permit a fast mounting of the components to be coated. For the protection of the surfaces of transition pieces and of component areas that are not to be coated, these surfaces may be coated with a layer of, for example, ceramic slip and may be dried, in which case this layer may be protected from chipping-off or crumbling-away by an embedding in donor metal powders.

An embedding of the workpiece holder with donor metal powder in the bottom area of the device has the advantage that an almost inexhaustible reservoir with a large donor metal surface is available for the donor metal gas supply of the donor metal gas sump. Therefore, a fine-grained powder pouring of donor metal is preferably arranged below the donor metal body.

The donor metal body preferably comprises one or several large-meshed baskets for granulates which are filled with large-grained donor metal granulates. Although large-grained donor metal granulates have a reduced surface on which donor metal gas may form, it can advantageously be layered laterally and above the component in the provided baskets without falling through the meshes of the basket and thus contaminating the component surface or clogging the bores in the outer surface.

If the donor metal body consists of one or several porous sintered bodies, the surface can advantageously be enlarged with a correspondingly higher porosity and baskets for maintaining the gap will not be required because of the dimensional stability of such a donor metal body. Donor metal bodies consisting of one or several porous sintered bodies are preferably used when large piece numbers are to be coated.

Another advantageous construction is a donor metal body which consists of a compact metal into which labyrinth structures are machined for the guiding of the gas. The labyrinth structures advantageously enlarge the donor metal body surface so that a slowly flowing carrier gas can be enriched with donor metal gas before it reaches the surfaces to be coated. This donor metal body, which may also have several parts, is placed in the inverted position over the component to be coated while maintaining a gap of a width of from 0.5 to 50 mm.

Other objects, advantages and novel features of the present invention will become apparent from the following detailed description of the invention when considered in conjunction with the accompanying drawings.

DETAILED DESCRIPTION OF THE DRAWINGS

Figure 1:
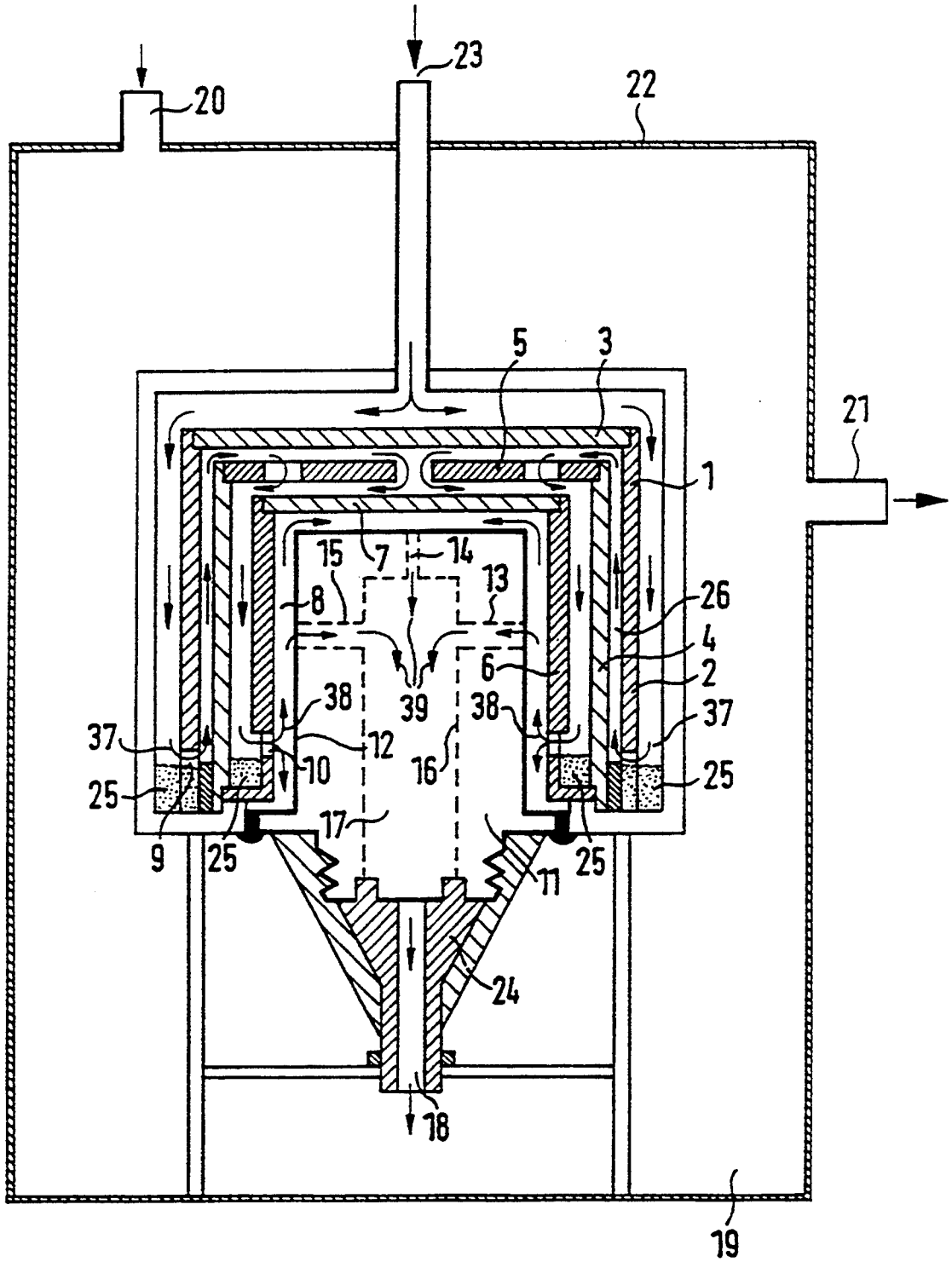
FIG. 1 is a schematic view of a device for coating by gas diffusion via a compact donor metal body.

FIG. 1 illustrates a device for coating by gas diffusion via a compact donor metal body 1 of hollow workpieces 11 made of heat-resistant alloys, such as Ni, Co or Fe base alloys, whose outer 12 and inner surfaces 16 are connected with one another by a plurality of bores 13, 14, 15. The device has a container 22 which has at least one gas supply line 23 and one gas removal line 21. The gas removal line 21 is connected behind the inner surfaces 16 to be coated. The container 22 is arranged in a processing chamber which is known per se.

At a geodetically low height with respect to the donor metal body 1, the workpieces 11 are held by workpiece holders 24. While maintaining a gap 8, the donor metal body 1 completely surrounds the outer surfaces 12 to be coated. The donor metal body 1 is self-supporting and is composed of several compact component parts 2 to 7, such as covers 3, 5, 7 and sleeves 2, 4, 6. The covers 3, 5, 7 and the sleeves 2, 4, 6 are spaced away from one another and form a labyrinth for guiding the gas. The outer sleeve 2 has openings 9 in the lower area which allow the gas to flow into the labyrinth in the direction of the arrow 37, and the inner sleeve 6 has openings 10 in the lower area which allow the gas to flow in the direction of the arrow 38 into the gap between the donor metal body 1 and the outer surfaces 12 to be coated. Through the bores 13, 14 and 15, the gas, which contains a large amount of donor metal, is supplied to the hollow spaces 17 in the direction of the arrow 39 for the coating of the inner surfaces 16. An exhaust gas pipe 18 ends, for example, open in a gas-swept space 19 which has another inlet 20, for example, next to the gas supply line 23.

For the coating by gas diffusion, the container 22 is heated so that a powdery activator 25 sublimes on the bottom of the labyrinth 26 and fills the labyrinth 26 with activator gas. On the surfaces of the donor metal body 1, a heavy donor metal gas is formed by a reaction with the activator gas, which donor metal gas precipitates metal, such as aluminum or aluminum alloys, on the outer surface 12 of the workpiece, the walls of the bores and the inner surface 16 of the workpiece. In order to prevent a flowing-off of the donor metal gas, the gas removal line in FIG. 1 is constructed as an overflow device, whose overflow level is arranged at the height of the highest workpiece edge. A powdery activator or an activator gas may also be fed by way of the gas supply line 23. When an activator gas is fed, the gas supply line 23 is heated above the sublimation temperature of the activator in order to avoid a condensation in the gas supply line.

Figure 2:
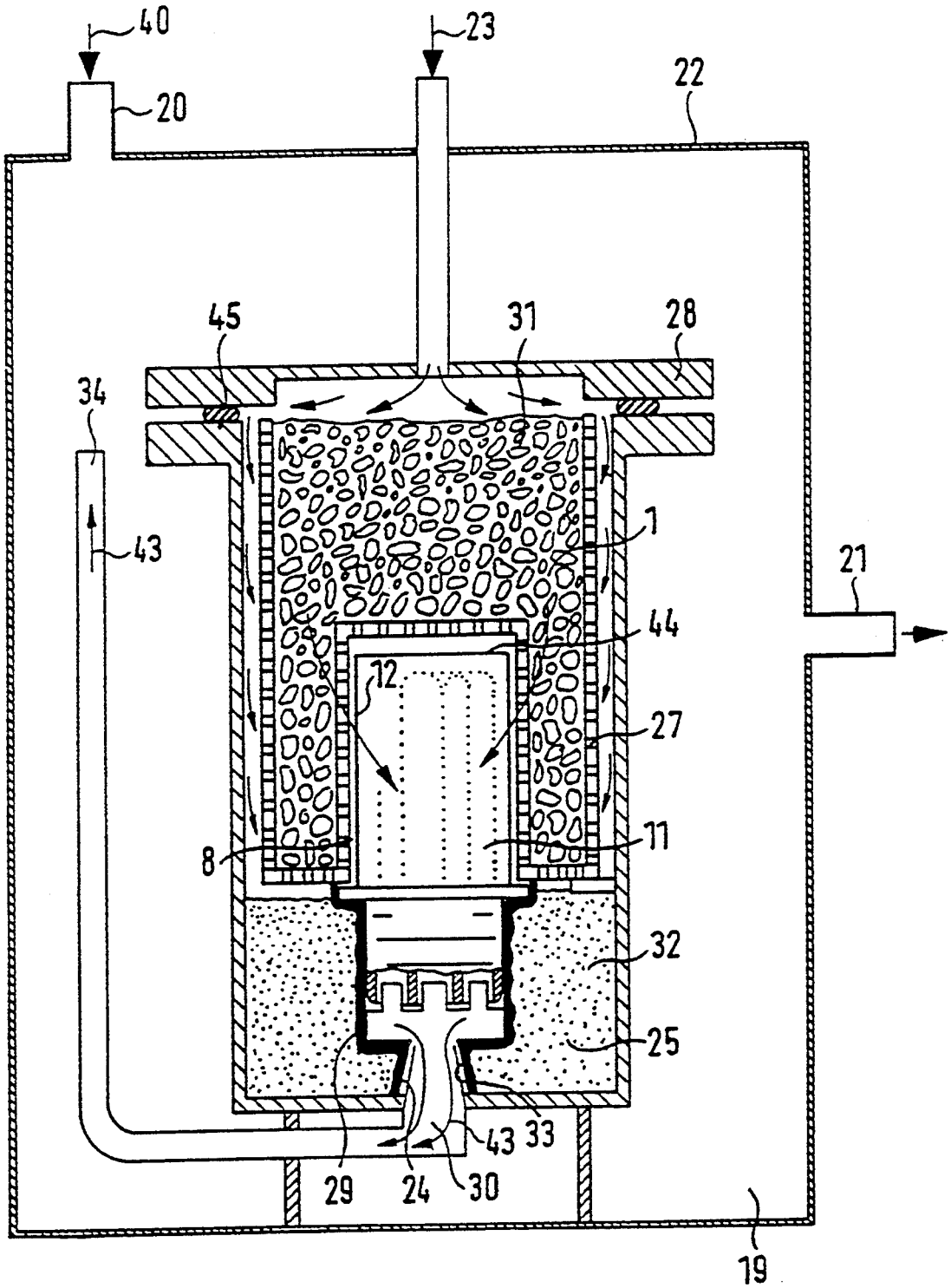
FIG. 2 is a schematic view of a device for coating by gas diffusion via a donor metal body made of baskets for granulates.

FIG. 2 illustrates a device for coating by gas diffusion using a donor metal body 1 made of baskets 27 for granulates. The baskets 27 for the granulates are designed such that they completely surround the workpiece 11 on the outer surfaces 12 to be coated while maintaining a gap 8 of from 2 to 5 mm. The particle size of the granulates 31 in the basket 27 is larger than the mesh width of the baskets. The granulates 31 consist of a donor metal, such as aluminum or aluminum alloys. Together with the workpiece 11 and a workpiece holder 24, the baskets 27 are arranged in a retort 28 which is closed in a gastight manner by means of a sealing device 45. On the bottom of the retort, activator powder 25, mixed with the donor metal powder 32, is arranged and, in addition, supplies donor metal gas to the retort chamber.

A cover layer 29 consisting of a slip mass of ceramic powder and metal powder, such as aluminum oxide powder and nickel powder, protects the surface of the workpiece holder 24 and outer surfaces of the workpiece 11 that are not to be coated from being coated. The mixture of the activator powder 25 and of the donor metal powder 32, at the same time, supports the ceramic layer 29 so that it will not chip-off or crumble-away.

In the bottom area, the retort 28 has a conical seat 33 for receiving the workpiece holder 24. A centrally arranged gas removal duct 30 guides the process gases in the direction of the arrow 43 out of the interior of the workpiece into the gas-swept chamber 19 by way of an overflow device 34. This overflow device has the effect that the heavy donor metal gas does not flow out of the workpiece interior in an uncontrolled manner because the overflow level is arranged to be higher than the uppermost workpiece edge 44. This achieves, at the same time, that, irrespective of the level of the gas removal line 21 of the container 22, a donor metal sump is formed in the retort 28.

The gas supply and gas sweeping of the space 19 with inert or reducing gas takes place in the direction of the arrow 40 by way of the inlet 20 and the gas removal line 21.

Figure 3:
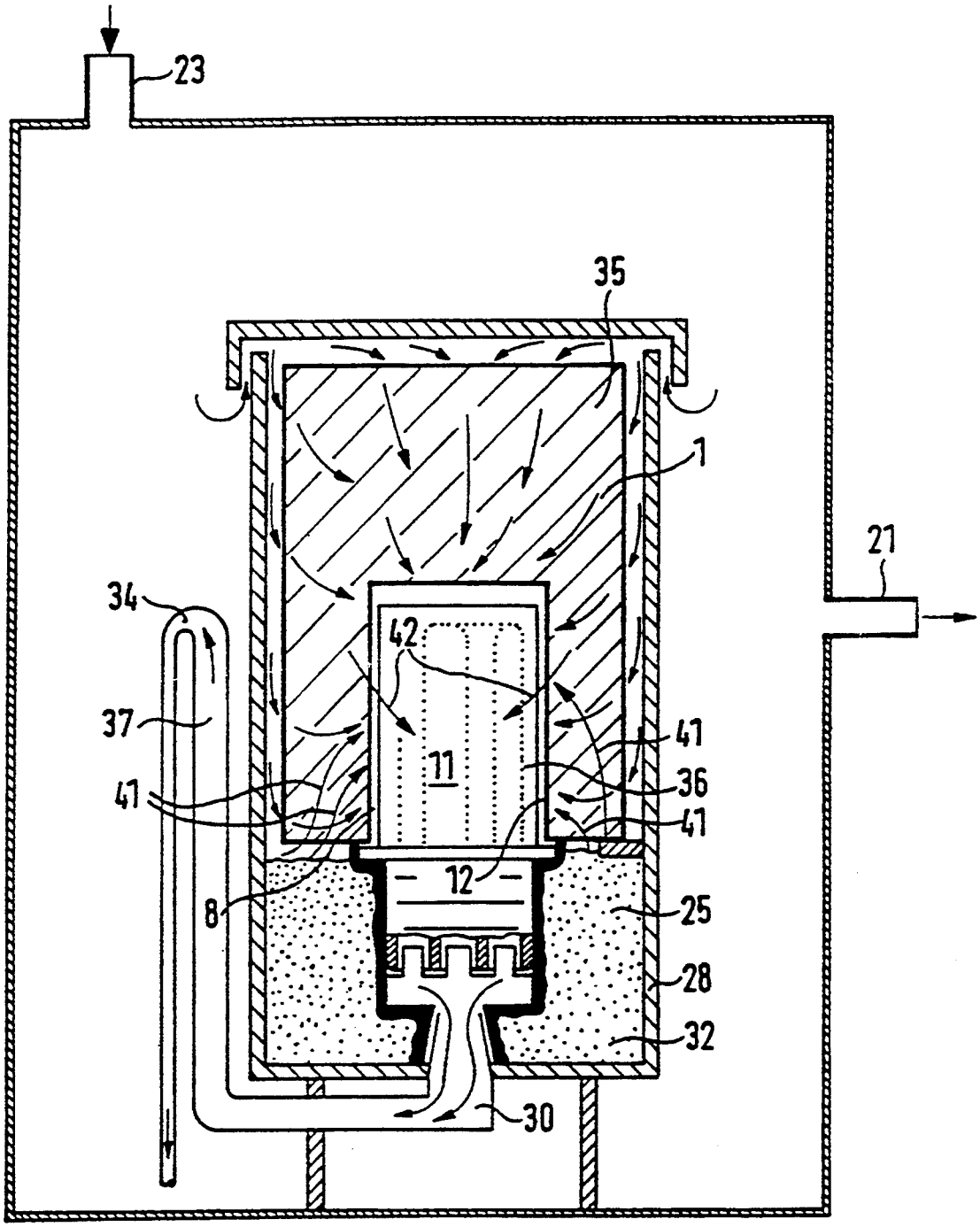
FIG. 3 is a schematic view of a device for coating by gas diffusion via a donor metal body made of a sintered metal.

FIG. 3 illustrates a device for coating by gas diffusion using a donor metal body 1 made of sintered metal 35, such as an aluminum alloy, which completely surrounds the outer surfaces 12 of the workpiece 11 to be coated while maintaining a gap 8. The sintered material 35 has a high concentration of open pores so that a high gas permeability is achieved. From the mixture of activator gas 25 and donor metal powder 32 in the bottom area of the retort, activator gas and donor metal gas diffuses in the direction of the arrow 41 through the donor metal body 1 to the workpiece 11, in which case the activator gas penetrates the whole donor metal body 1 and forms donor metal gas and on all sides supplies the surfaces of the workpiece 11 to be coated with donor metal. Through the bores 36 between the outer 12 and inner surfaces of the workpiece 11, the donor metal gas arrives, in the direction of the arrow 42, while coating the outer 12 and inner surfaces, in the hollow spaces of the workpiece 11.

The heavy donor metal gas builds up in the gas removal duct 30 and fills the ascending pipe 37 constructed as a siphon to the overflow level 34 of the ascending pipe 37. The heavy donor metal gas which forms in the donor metal body 1 above the overflow level 34 and thus above the highest workpiece edge 50 constantly presses a donor metal gas current through the ascending pipe 37 constructed as a siphon so that a uniform and thick coating of the inner and outer surfaces 12 of the workpiece 11 will take place.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A gas diffusion coating device for coating hollow workpieces made of heat-resistant alloys, said hollow workpieces having their outer and inner surfaces connected with one another by bores, the device comprising:

a container having at least one gas supply line and at least one gas removal line, said gas removal line being connected to the hollow space within the inner surfaces of the workpiece to be coated;

a donor metal, in the form of a donor metal body, completely surrounding the outer and inner surfaces of the workpiece while maintaining a gap between the donor metal body and the outer surfaces;

workpiece holders arranged in the container, said holders holding the workpieces at a height geodetically below the donor metal;

wherein the hollow space within the inner surfaces are free of donor metal and wherein the gas removal line is constructed as one of an overflow opening for as removal arranged at an uppermost surface of the workpiece and a positioned between an overflow opening and the gas removal line of the container, the siphon having an overflow level positioned at the uppermost surface of the workpiece to be coated.

2. A device according to claim 8, wherein the workpiece holder comprises a conical seat which has a centrally arranged gas removal duct and corresponds with connecting bores leading to hollow spaces of the workpieces.

3. A device according to claim 1, wherein a fine-grained powder of donor metal is arranged below the donor metal body.

4. A device according to claim 2, wherein a fine-grained powder of donor metal is arranged below the donor metal body.

5. A device according to claim 1 wherein the donor metal body comprises at least one large-meshed basket for granulates which is filled with large-grained donor metal granulates.

6. A device according to claim 2, wherein the donor metal body comprises at least one large-meshed basket for granulates which is filled with large-grained donor metal granulates.

7. A device according to claim 3, wherein the donor metal body comprises at least one large-meshed basket for granulates which is filled with large-grained donor metal granulates.

8. A device according to claim 1 wherein the donor metal body comprises a compact metal into which labyrinth structures are machined for the guiding of the gas.

9. A device according to claim 2, wherein the donor metal body comprises a compact metal into which labyrinth structures are machined for the guiding of the gas.

10. A device according to claim 3, wherein the donor metal body comprises a compact metal into which labyrinth structures are machined for the guiding of the gas.

11. A device according to claim 5, wherein the donor metal body comprises a compact metal into which labyrinth structures are machined for the guiding of the gas.

* * * * *